US006237895B1

(12) United States Patent
Thurston

(10) Patent No.: US 6,237,895 B1
(45) Date of Patent: May 29, 2001

(54) CROWD CONTROL RAIL ASSEMBLY

(76) Inventor: Kurt W. Thurston, P.O. Box 1887, Reno, NV (US) 89505

( * ) Notice: Subject to any disclaimer, the term of this patent is extended or adjusted under 35 U.S.C. 154(b) by 0 days.

(21) Appl. No.: 09/316,151

(22) Filed: May 21, 1999

(51) Int. Cl.[7] ..... E01F 13/00; E01F 13/02

(52) U.S. Cl. ..... 256/13.1; 256/1; 256/59; 40/612; 116/63 P; 404/6; 404/9

(58) Field of Search ..... 256/65, 67, 1, 256/19, 66, 59, 64; 404/6, 10, 9; 116/63 T, 63 P, 63 R; 40/606, 610, 612

(56) References Cited

U.S. PATENT DOCUMENTS 2,889,177 * 6/1959 Rambow .
2,911,265 * 11/1959 Hannah .
3,866,884 * 2/1975 Heil et al. .
4,883,246 * 11/1989 Esposito .
4,943,035 * 7/1990 Thomson et al. ..... 404/6
5,003,912 * 4/1991 Thurston .
5,030,029 * 7/1991 Johnsen ..... 404/6
5,303,850 * 4/1994 McQuiston .
5,621,992 * 4/1997 Mandell .
5,762,444 * 6/1998 Giannelli .
5,794,923 * 8/1998 Bartlett .
5,975,500 * 11/1999 Orton et al. .

* cited by examiner

*Primary Examiner*—Lynne H. Browne
*Assistant Examiner*—Tomlyne A Malcolm
(74) *Attorney, Agent, or Firm*—Jerry G. Wright; Flehr Hohbach Test Albritton & Herbert LLP

(57) ABSTRACT

A crowd control rail assembly includes at least two foldable plastic barricades constructed from two substantially similar integrally molded planar frame units. A planar cross-panel at the upper end of the barricade includes a vertically elongated slot into which the end of an elongated plastic rail unit may be inserted. Notches are provided at each end of the rail. Dimensions of the rail are chosen so that it must be inserted into the slot substantially perpendicular to the planar face of the upper portion of the frame unit and, then when the notch engages the bottom of the slot and the barricade is unfolded, the rail is automatically and securely retained.

3 Claims, 6 Drawing Sheets

CROWD CONTROL RAIL ASSEMBLY

FIELD OF INVENTION

The present invention is directed to a crowd control rail assembly and more specifically to an assembly using a pair of unfolded barricades in combination with a plastic rail.

BACKGROUND OF THE INVENTION

For crowd control, it is known to link together simple spaced so-called A-frames with horizontal rails; the frames, of course, are not free-standing and they are easily jarred loose. Thus, especially for police use, free-standing metal-type grids which interlock are commonly used. These are, of course, relatively cumbersome and expensive. In the highway field as illustrated by U.S. Pat. No. 5,003,912, barricades of molded plastic have been known for some time. They typically includes two frame or panel units hinged together so they can be spread apart for use. The individual panel units are one-piece, integral, hollow plastic panels formed by rotational or blow molding. For increased stability, the hollow plastic panels may be filled with sand as a ballast. To provide for crowd control, it would be desirable to link these barricades together in a manner in which an interlinking rail is not easily jarred loose.

OBJECT AND SUMMARY OF INVENTION

Thus, it is a general object of the present invention to provide an improved crowd control rail assembly.

In accordance with the above object, there is provided a crowd control rail assembly comprising at least two plastic barricades each constructed from two substantially similar planar frame units which are integrally molded, each unit having a pair of legs with bases at one end and hinged together at the other end and having a upper planar face substantially extending between the two legs to form a one-piece unit, each barricade being free-standing on its bases when the frame units are open. Each planar face includes a vertically elongated pass through slot. An elongated rail, having two ends, of rectangular cross-section is adapted for insertion of its two ends into the slots of the spaced barricades, the rail having bottom notches close to each end mating with the bottom of said slots.

In addition, a method of forming a rail assembly is provided.

DESCRIPTION OF PREFERRED EMBODIMENT

Figure 1:
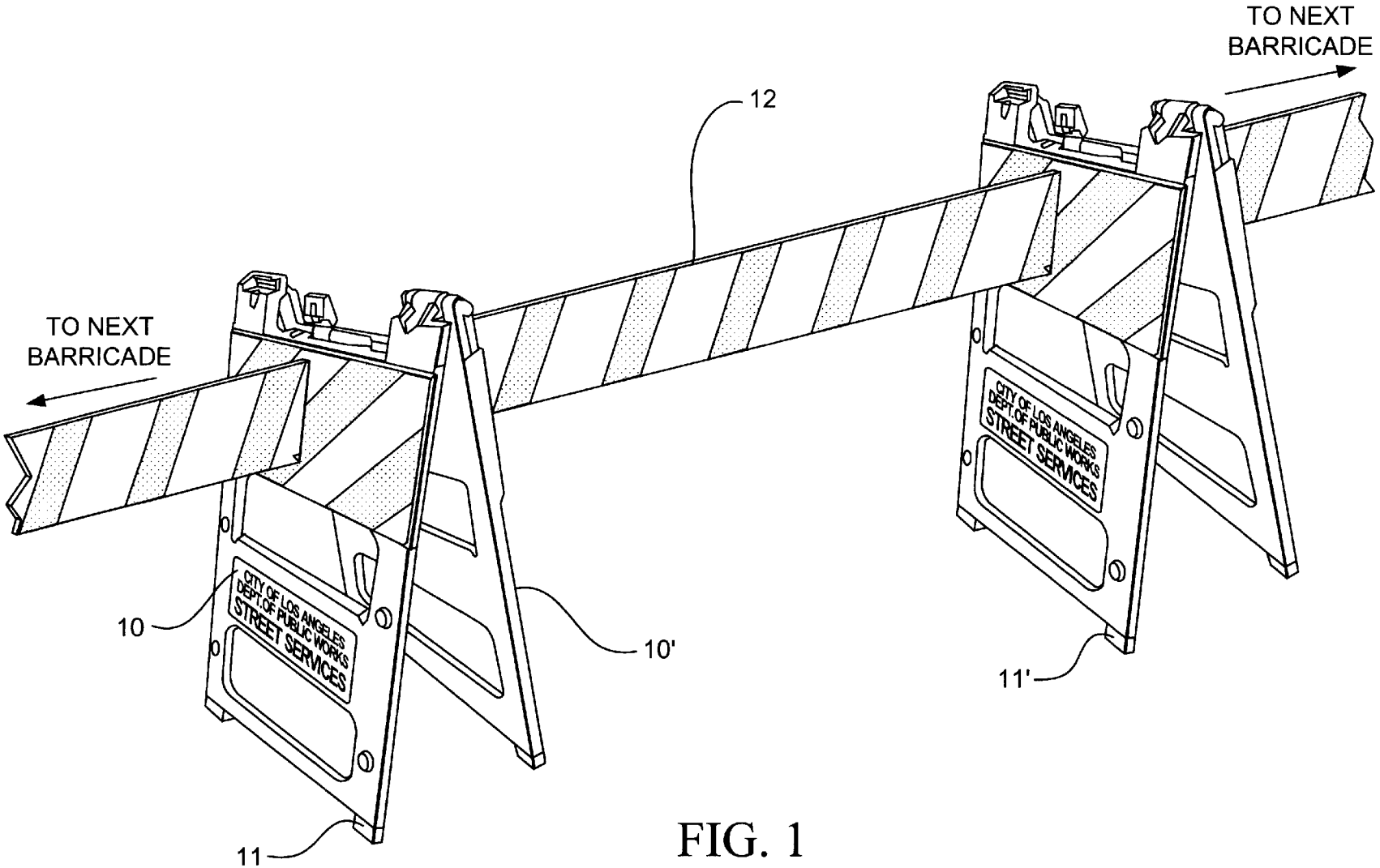
FIG. 1 is a simplified perspective view illustrating the crowd control rail assembly of the present invention.

FIG. 1 illustrates a pair of foldable barricades 11 and 11' each of which consists of identical integral hollow plastic panel or planar frame units 10 and 10'. An elongated rail 12 is inserted in slots in the face of each of the barricades to form one link of a crowd control rail assembly. As will be described below, since each frame unit 10 is identical to the next frame unit 10', each has a slot in it so that a continuous line of rails can be interlinked as desired. Barricades 11 and 11', etc., can be filled with sand or other ballaster for stability. As will be discussed below, the rail and its technique of insertion into the respective slots provides a crowd control rail assembly which cannot easily be jarred loose or toppled.

Figure 2:
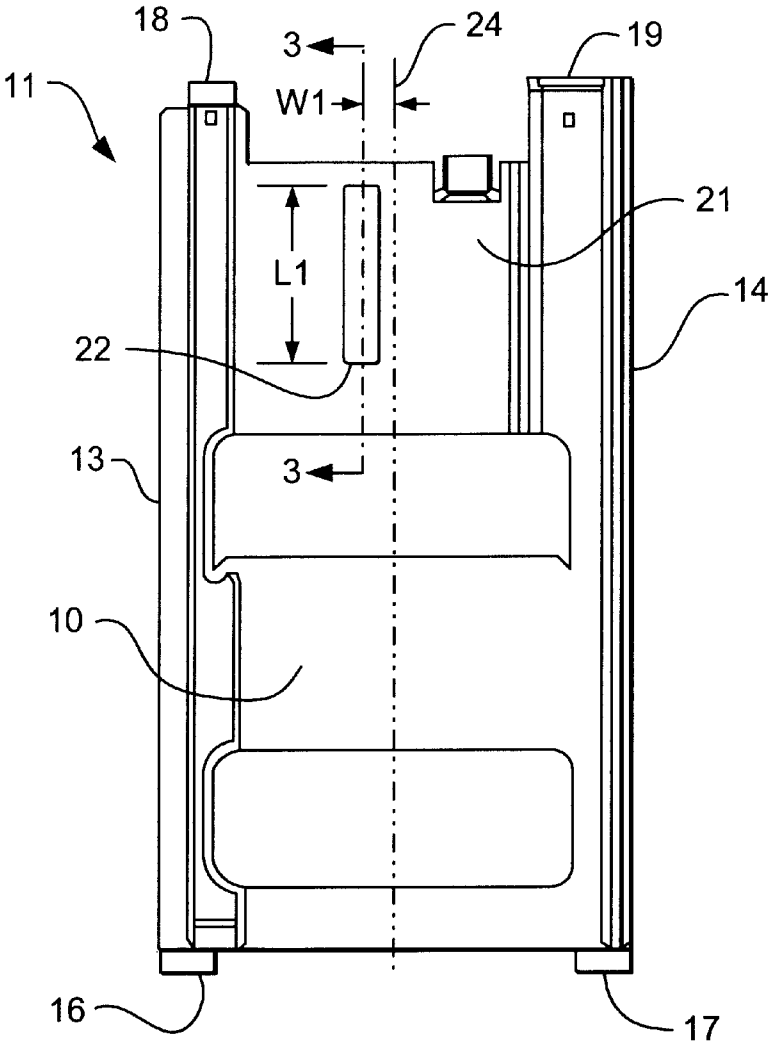
FIG. 2 is a plane view of one face of a barricade shown in FIG. 1.

Referring now to FIG. 2, there is illustrated a barricade 11 with its frame unit 10 having a pair of legs 13 and 14 with bases 16 and 17 at one end (which will stand on the ground surface) and at the other ends 18 and 19 are hinge assemblies to fasten one frame unit 10 to another frame unit 10'. Such pivoting attachment or hinging is illustrated in the above '912 patent. See also U.S. Pat. No. 5,009,541. Extending between legs 13 and 14 in the upper portion of the panel 10 is a upper planar face 21 which includes a vertically elongated slot 22.

Figure 3:
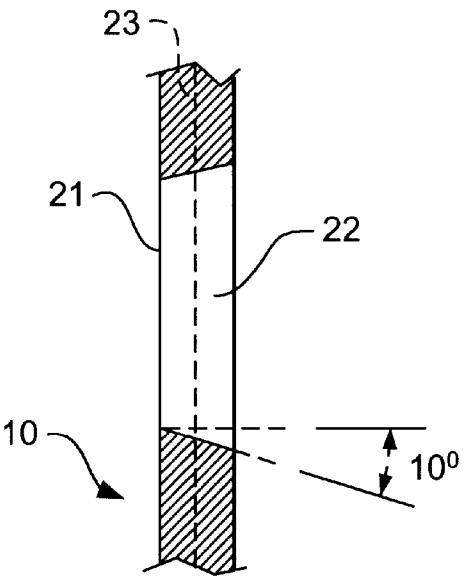
FIG. 3 is a cross-sectional view taken substantially along the line 3—3 of FIG. 2.

Such slot is shown in greater detail in FIG. 3. Since the frame unit 10 is integrally molded, it has a parting line 23 and as illustrated the draft angle used in molding of the slot 22 is 10°. Referring back to FIG. 2, the vertically elongated slot has a vertical length, L1 (with reference to the parting line 23), and width, W1. As illustrated, it is offset from the center line 24 of the frame unit 10 so that the opposite frame unit 10' (which has been molded in an identical mold) will have its slot offset in the opposite direction to prevent interference between interlinked rails 12.

Figure 5:
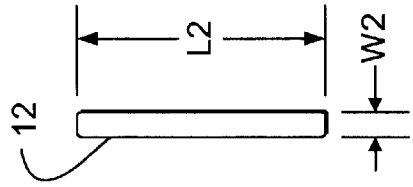
FIG. 5 is an end view of FIG. 4.
Figure 4:
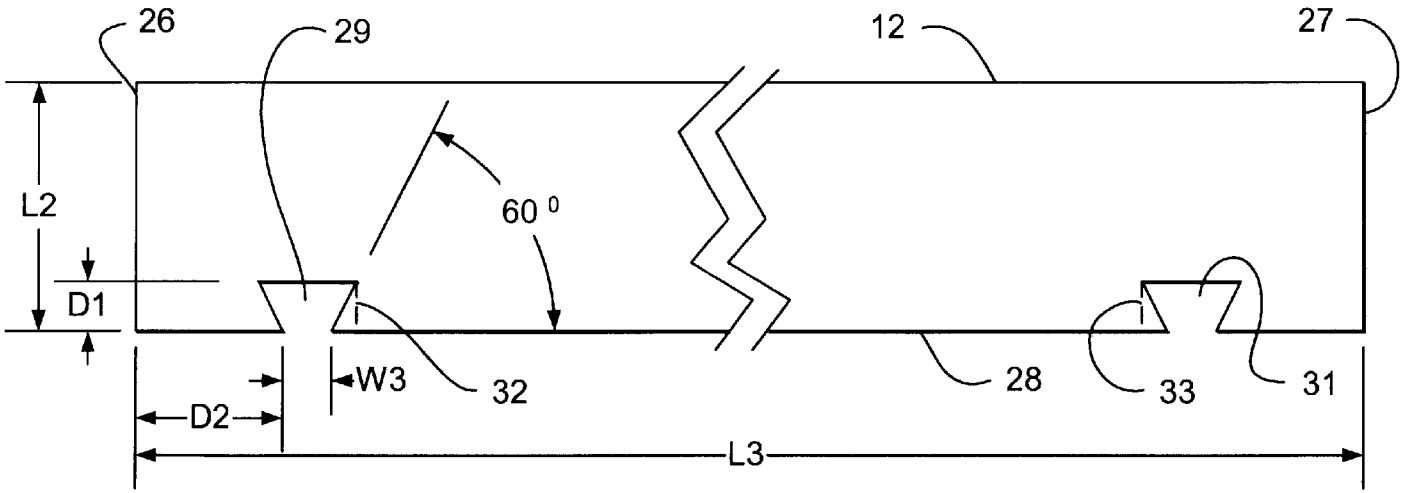
FIG. 4 is a plane view of a rail used in the present invention.

FIG. 4 illustrates a typical plastic molded rail 12 which has a rectangular cross-section illustrated in FIG. 5 with a width, W2, and a vertical length, L2. The rail, of course, has two ends 26 and 27 and near the two ends on its bottom edge 28 are a pair of notches 29 and 31. The notches have angled sides (for example, indicated at 60°) to better mate with interior faces of the opposite or interior side of the panels 21. Thus, as indicated by the dashed lines 32 and 33, that portion of the notch which would be adjacent the exterior face of the frame unit is not critical. However, the angled face of 60° should match the widest opening angle of the barricade 11 as will be discussed below.

Figure 6:
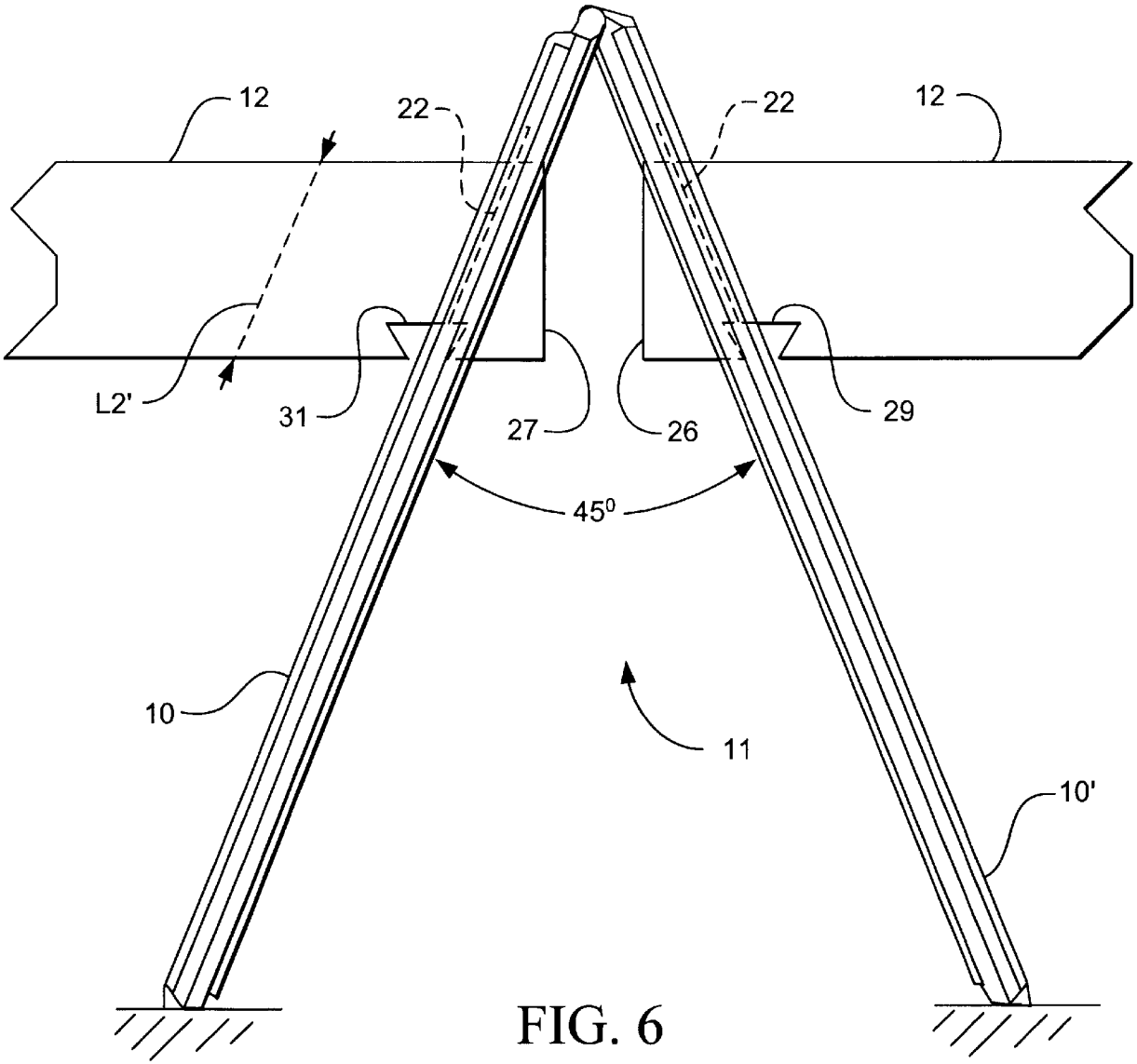
FIG. 6 is a side elevational view showing a barricade with to rails inserted.

Since the ends of the rail 26 and 27 must be inserted into the slot 22, necessarily the dimension, W2, is slightly less than the thickness of the slot, W1, as illustrated in FIG. 2; and the dimension, L2, is less than L1. For example, typical dimensions are W1=1.25 inches, W2=1.0 inches, L1=8.50 inches, L2=8.0 inches. The depth, D1, of the notches 29 and 31 is approximately 1.5 inches. The width, W3, of the notch may also be 1.5 inches and the notches are spaced a distance, D2, approximately 4.5 inches from the ends 26 and 27. The total length, L3, of rail 12 may vary as desired and typically is 8 to 10 feet. Such rail is molded plastic and may be purchased as an off-the-shelf item (with the exception of the notches 29 and 31) in its original use as tongue and grooved flooring. FIG. 6 illustrates a barricade 11 with two rails 12 inserted in its respective slots 22. This barricade is open at an angle of 45°. Thus, the interior faces of the frame units 10 and 10' do not totally mesh with the notches 29 and 31 although they are accommodated. Compare FIG. 7 which shows an open angle of 60° where the interior faces of the frame units are substantially co-planar with the angled surfaces of the notches 29 and 31.

Figure 7:
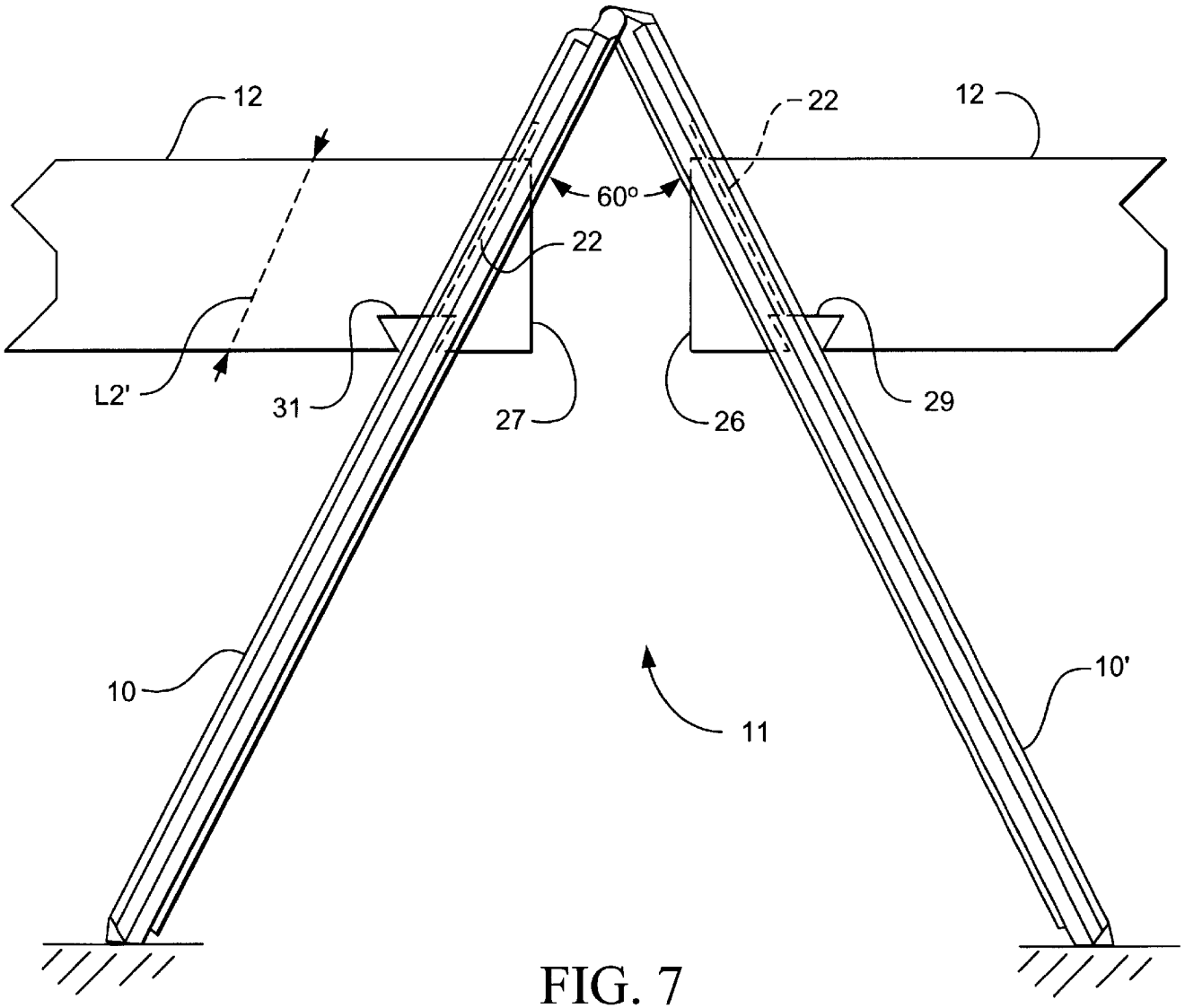
FIG. 7 is a side elevational view of a barricade in a wider open position with two rails inserted.

Referring to both FIGS. 6 and 7, to prevent accidental jarring loose of the rails after being inserted in the slots, the L2' slant dimension of the rail measured at 22½ for the 45° open barricade of FIG. 6 or at 30° for the 60° barricade of FIG. 7, this dimension is greater than L1 the vertical length of the slot 22. Thus, when barricade 11 is open and free-standing at a significant angle such as 45° or 60° and the rail 12 is in its normal substantially horizontal position the rail cannot be removed. Of course, this is also made possible because the ends 26 and 27 pass entirely through the slots 22 so that the upper edge of rail 12 bears against the top of the slot 22.

Figure 8:
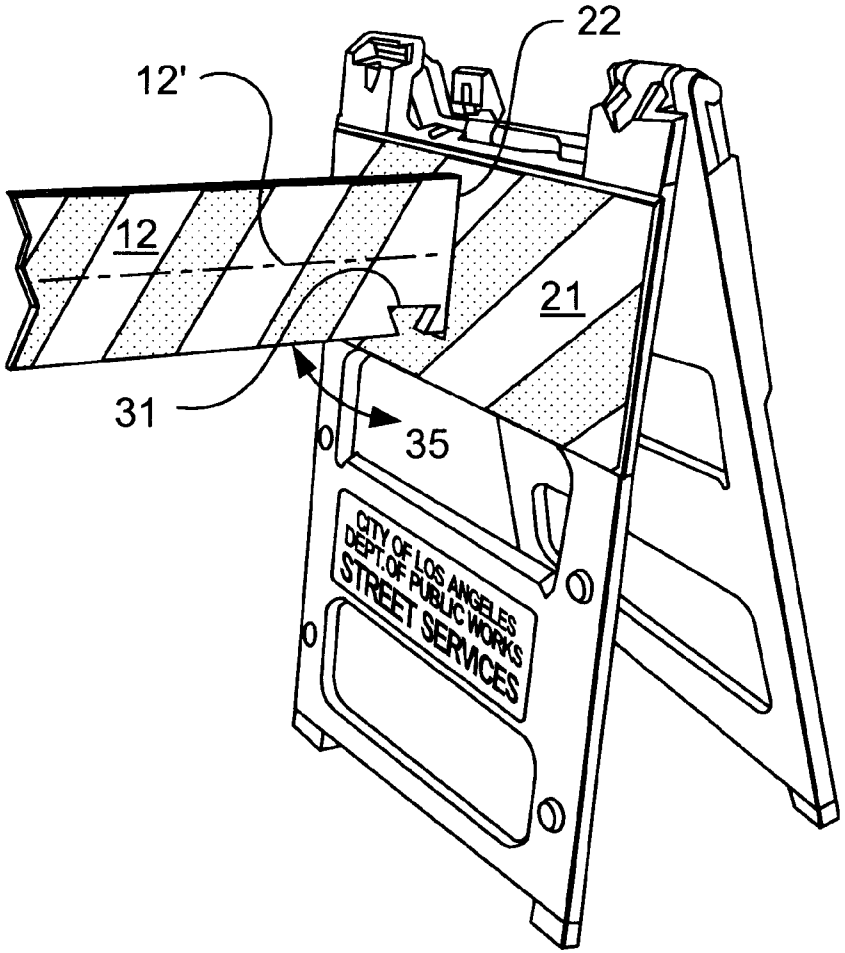
FIG. 8 is a perspective view of a barricade and a rail showing the process of insertion of a rail into a slot.

In summary, referring to FIG. 7 the L2' dimension might typically be 9 inches keeping in mind the dimension of 8.5 inches for L1, and the slant L2' in FIG. 6 is 8.7 inches. Thus, it is apparent as illustrated in FIG. 8 that in the process of assembling the rail assembly of the elongated axis 12' of the rail 12 must be substantially or almost perpendicular, as illustrated by the angle 35, with the planar face 21 which will allow the end of rail 12 to be slid into the slot and allow the notch 31 of the rail to engage the slot. Then after the notch engages, both the barricade or the rail may be rearranged so that the rail is oriented at a significant angle with respect to face 21 as illustrated in FIGS. 6 and 7. The normal dimension, L2, of rails 12 prevent their insertion into the slots 22 at a significant angle other than perpendicular but at the same time the removal of the rail by accidental jarring is prevented. This is illustrated both in FIGS. 6 and 7 where the top edge of the rail 12 will be firmly mated against the top portion of slot 22. The ends 26 and 27, however, are not sufficiently long, that is, the distance, D2, as illustrated in FIG. 4 is not sufficiently long to insert into the slot without interference from the adjacent frame unit 10 or 10'.

Another advantage of the foregoing construction is that the entire rail assembly may be horizontally shifted on the ground without being pulled apart. On the other hand, when it is desired to disassemble the units, the rail 12 may be grasped in both hands and pulled upwards to allow a frame unit 10 or 10' to fold toward the vertical and then the rail may be removed. Thus, a improved crowd control rail assembly has been provided.

What is claimed is:

1. A crowd control rail assembly comprising:

at least two plastic barricades each constructed from two substantially similar planar frame units which are integrally molded, each unit having a pair of legs with bases at one end and hinged together at the other end on an axis and having a upper planar face substantially extending between the two legs to form a one-piece unit with said planar faces opposed to each other and co-linear with said axis, each said barricade being free-standing on its bases when the frame units are open at a significant angle of substantially 45° to 60°, each planar face including a vertically elongated pass through slot having a vertical length, L1, and width, W1, and an elongated rail, having two ends, of rectangular cross-section, L2, W2, adapted for insertion of its two ends into said slots of spaced barricades, said rail having bottom notches close to each end substantially matching the thickness of said slots and mating with the bottom of said slots, the dimension W2 being slightly less than W1 and the dimension L2 less than L1, but the dimension of a slant line, L2', measured parallel to said planar face having said slot when said barricade is open at said significant angle being greater than L1 so that said rail cannot be removed from said slot when its said associated barricade is open and free-standing.

2. A crowd control rail assembly as in claim 1 where both the top and bottom of said rail in said L2 direction passes entirely through a slot into which the rail is inserted when the associated barricade is in an unfolded free-standing position.

3. A method of forming a crowd control rail assembly having at least two plastic barricades each constructed from two substantially similar planar frame units which are integrally molded, each frame unit having a pair of legs with bases at one end and hinged together at the other end on an axis and having a upper planar face substantially extending between the two legs to form a one-piece frame unit with said planar faces opposed to each other and co-linear with said axis, each said barricade being free-standing on its bases when the frame units are open at a significant angle, comprising the steps of, for each planar face, forming a vertically elongated pass through slot having a vertical length, L1, and width, W1, providing an elongated rail, having two ends, of rectangular cross-section, L2, W2, adapted for insertion of its two ends into said slots of spaced barricades, said rail having bottom notches close to each end substantially matching the thickness of said slots and mating with the bottom of said slots the dimension W2 being slightly less than W1 and the dimension L2 less than L1, and inserting said rail ends into said slots only while the elongate axis of the rail is substantially perpendicular to the planar face, and allowing the notch of the rail to engage said slot so that said rail may be oriented at a significant angle to said planar face, other than perpendicular, said dimension L2 of a rail preventing its horizontal insertion into said slot when said frame unit is open at said significant angle.

* * * * *